US010107526B2

(12) United States Patent
Xie et al.

(10) Patent No.: US 10,107,526 B2
(45) Date of Patent: Oct. 23, 2018

(54) SWITCHABLE TWO-STAGE AND CASCADE MARINE ENERGY-SAVING ULTRALOW-TEMPERATURE REFRIGERATION SYSTEM

(71) Applicant: Shanghai Ocean University, Shanghai (CN)

(72) Inventors: Jing Xie, Shanghai (CN); Yaojun Guo, Shanghai (CN); Jinfeng Wang, Shanghai (CN); Yizhe Li, Shanghai (CN); Minsheng Xu, Shanghai (CN)

( * ) Notice: Subject to any disclaimer, the term of this patent is extended or adjusted under 35 U.S.C. 154(b) by 232 days.

(21) Appl. No.: 15/185,025

(22) Filed: Jun. 17, 2016

(65) Prior Publication Data

US 2016/0334143 A1 Nov. 17, 2016

Related U.S. Application Data

(63) Continuation of application No. PCT/CN2015/097554, filed on Dec. 16, 2015.

(30) Foreign Application Priority Data

May 12, 2015 (CN) ..... 2015 1 0236044

(51) Int. Cl.
*F25B 43/00* (2006.01)
*F25B 43/02* (2006.01)
(Continued)

(52) U.S. Cl.
CPC ..... *F25B 7/00* (2013.01); *F25B 41/04* (2013.01); *F25B 41/062* (2013.01);
(Continued)

(58) Field of Classification Search
CPC ..... F25B 7/00; F25B 2400/054; F25B 41/04; F25B 41/062; F25B 43/02; F25B 43/003;
(Continued)

(56) References Cited

U.S. PATENT DOCUMENTS 3,590,595 A * 7/1971 Briggs ..... F25B 7/00 62/197
4,402,189 A * 9/1983 Schaeffer ..... F25B 49/027 62/335

(Continued)

FOREIGN PATENT DOCUMENTS

KR 101350611 B1 * 1/2014
KR 101350611 B1 * 1/2014 ..... F25B 7/00

*Primary Examiner* — Keith M Raymond
*Assistant Examiner* — Miguel A Diaz
(74) *Attorney, Agent, or Firm* — Wayne & Ken, LLC; Tony Hom

(57) ABSTRACT

The present invention discloses a switchable two-stage and cascade marine energy-saving ultralow-temperature refrigeration system which comprises a high-temperature level refrigeration system, a low-temperature level refrigeration system, a hot fluorine defrosting system of a high-temperature level air cooler and a hot fluorine defrosting system of a low-temperature level air cooler. The hot fluorine defrosting system of the high-temperature level air cooler comprises a high-temperature level compressor of which the outlet is divided into two paths through a first oil separator; and the second path is connected with an air suction port of the high-temperature level compressor through a first solenoid valve, the high-temperature level air cooler, a third solenoid valve, a first pressure relief valve, a first gas-liquid separator, a first one-way valve and a first heat regenerator. The hot fluorine defrosting system of the low-temperature level air cooler comprises a low-temperature level compressor of which the outlet is divided into two paths through a precooler and a second oil separator; and the second path is connected with an air suction port of the low-temperature level compressor through an eighth solenoid valve, the low-temperature level air cooler, a sixth solenoid valve, a second pressure relief valve, a second gas-liquid separator, a third one-way valve and a second heat regenerator. The
(Continued)

present invention has the obvious effects of large refrigeration section, high cooling rate, good energy-saving effect and thorough defrosting.

8 Claims, 1 Drawing Sheet

(51) Int. Cl.

| | |
|---|---|
| ***F25B 47/02*** | (2006.01) |
| ***F25B 47/00*** | (2006.01) |
| ***F25B 7/00*** | (2006.01) |
| ***F25B 41/04*** | (2006.01) |
| ***F25B 41/06*** | (2006.01) |

(52) U.S. Cl.
CPC ..... *F25B 43/003* (2013.01); *F25B 43/02* (2013.01); *F25B 47/022* (2013.01); *F25B 2339/047* (2013.01); *F25B 2341/0661* (2013.01); *F25B 2341/0662* (2013.01); *F25B 2400/054* (2013.01)

(58) Field of Classification Search
CPC ..... F25B 47/022; F25B 2341/0661; F25B 2341/0662; F25B 2339/047
See application file for complete search history.

(56) References Cited

U.S. PATENT DOCUMENTS

| | | | | | |
|---|---|---|---|---|---|
| 4,550,574 | A * | 11/1985 | Hohman | F25B 5/00 | 62/196.3 |
| 5,477,697 | A * | 12/1995 | Wharton | F25B 7/00 | 62/117 |
| 9,845,973 | B2 * | 12/2017 | Tsai | F25B 7/00 | |
| 2002/0017106 | A1 * | 2/2002 | Flynn | F25B 40/00 | 62/156 |
| 2004/0020221 | A1 * | 2/2004 | Flynn | C09K 5/045 | 62/156 |
| 2006/0075775 | A1 * | 4/2006 | Boiarski | F25B 7/00 | 62/612 |
| 2006/0168976 | A1 * | 8/2006 | Flynn | F25B 9/006 | 62/196.4 |
| 2009/0272128 | A1 * | 11/2009 | Ali | F25B 7/00 | 62/56 |
| 2014/0352343 | A1 * | 12/2014 | Hinde | F25B 1/10 | 62/277 |
| 2015/0191182 | A1 * | 7/2015 | Abou Eid | B61D 27/0018 | 62/80 |
| 2015/0198357 | A1 * | 7/2015 | Kobayashi | C09K 5/042 | 62/510 |
| 2017/0030619 | A1 * | 2/2017 | Kim | F25B 5/04 | |
| 2017/0167758 | A1 * | 6/2017 | Tsai | F25B 7/00 | |
| 2017/0248349 | A1 * | 8/2017 | Kujak | F25B 13/00 | |

* cited by examiner

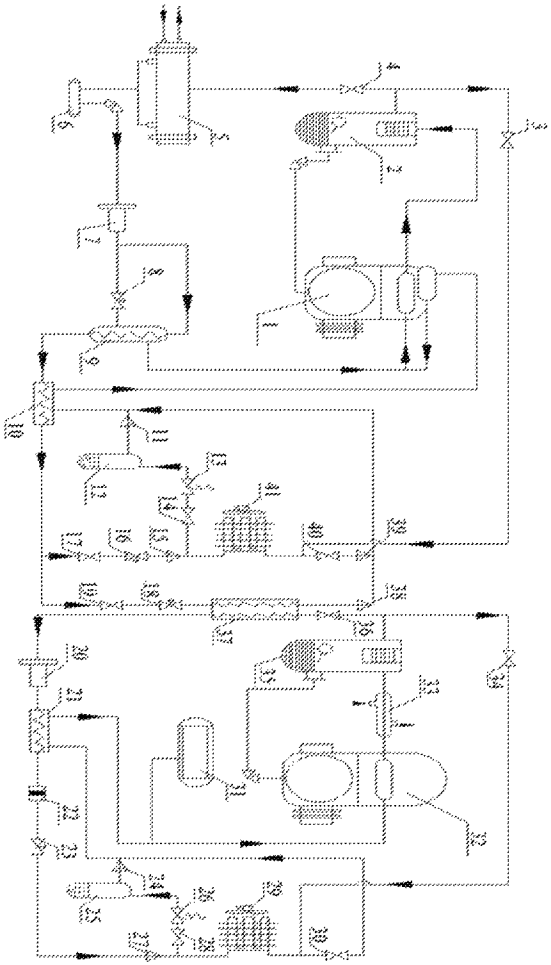

SWITCHABLE TWO-STAGE AND CASCADE MARINE ENERGY-SAVING ULTRALOW-TEMPERATURE REFRIGERATION SYSTEM

CROSS-REFERENCE TO RELATED APPLICATIONS

This application is a continuation of International Patent Application No. PCT/CN2015/097554 with a filing date of Dec. 16, 2015, designating the United States, now pending, and further claims priority to Chinese Patent Application No. 201510236044.9 with a filing date of May 12, 2015. The content of the aforementioned applications, including any intervening amendments thereto, are incorporated herein by reference.

TECHNICAL FIELD

The present invention belongs to the technical field of refrigeration and low temperature, and relates to a switchable two-stage and cascade marine energy-saving ultralow-temperature refrigeration system, and particularly relates to a switchable two-stage and cascade ultralow-temperature refrigeration system, having a hot fluorine defrosting loop of an air cooler.

BACKGROUND OF THE PRESENT INVENTION

A two-stage compression refrigeration system conducts a compression process in two stages, i.e., increasing intermediate pressure between condensing pressure and evaporating pressure; and low-voltage refrigerant vapor from an evaporator is firstly compressed from evaporating pressure at a low-pressure stage of the compressor into appropriate intermediate pressure, then enters a high-pressure stage after being intercooled, and is compressed again from the intermediate pressure into the condensing pressure, thereby forming two-stage compression. A cascade refrigeration system consists of two refrigeration systems, respectively known as a high-temperature portion and a low-temperature portion. The high-temperature portion uses an intermediate pressure refrigerant and the low-temperature portion uses a low-temperature and high-pressure refrigerant. An overlapped device of the high-temperature portion and the low-temperature portion is a condensation evaporator which is an evaporator of the high-temperature portion as well as a condenser of the low-temperature portion. In the condensation evaporator, an intermediate temperate refrigerant of the high-temperature portion performs vaporization and heat absorption for condensation of the refrigerant of the low-temperature portion.

In refrigeration engineering, when evaporating temperature reaches a temperature below −25° C., only a small refrigeration device still adopts a single-stage compression refrigeration system in order to simplify the system, but the minimum temperature can only reach −40° C. In a large system for, e.g., freezing processing of food, when the evaporating temperature of −30° C. to −60° C. is prepared, a two-stage compression refrigeration system is generally used and when the evaporating temperature of −60° C. to −80° C. is required to be prepared, the two-stage compression refrigeration system often cannot satisfy the requirement due to the limitation of such factors as refrigerant solidifying point, system pressure ratio, evaporating pressure, operational economics, etc. At this moment, a cascade refrigeration system is required to be adopted. That is: the evaporating temperature of the two-stage compression refrigeration system is generally regulated as −30° C. to −60° C., and the evaporating temperature of the cascade refrigeration system is generally regulated as −50° C. to −80° C.

To extend a section of refrigeration temperature of the cascade refrigeration system, a patent documentation with the publication No. of CN202973641U discloses a −80° C. series-parallel automatic switching cascade refrigeration system which comprises a high-temperature level refrigeration system and a low-temperature level refrigeration system. An outlet of a high-temperature level compressor is communicated with a liquid storage tank through a high-temperature condenser; an outlet of the liquid storage tank is divided into two paths through a drying filter; an outlet of the low-temperature level compressor is divided into two paths; one path of an outlet of an expansion vessel is communicated with an inlet of the low-temperature level compressor; the other path is communicated with a low-temperature evaporator through a tubular exchanger; and an outlet of the low-temperature evaporator is communicated with an inlet of the low-temperature level compressor through an oil separator. The system during operation respectively realizes temperature control of high-temperature level refrigeration (room temperature to −40° C.) and low-temperature level refrigeration (−40° C. to −80° C.) by switching solenoid valves, so as to realize temperature control from room temperature to −80° C., thereby obtaining large scope of refrigeration section, increasing the operating efficiency of the compressor and reducing operating cost. However, because the high-temperature level of the above refrigeration system adopts the single-stage compression refrigeration system, as mentioned previously, in the refrigeration engineering, when the evaporating temperature is below −25° C., corresponding evaporating pressure is also low and the pressure ratio pk/po is too large, often leading to greater deviation of an actual compression process of the compressor from an isentropic degree, thereby increasing actual power consumption of the compressor and decreasing the efficiency; overlarge pressure ratio may also result in an increase in exhaust gas temperature of the compressor, while overhigh exhaust gas temperature will result in thinning and even carbonization of lubricating oil. Therefore, the single-stage compression refrigeration system is not adopted.

At present, a conventional defrosting mode of an air cooler is to adopt traditional electrical heating for defrosting. Defrosting time is controlled by a defrosting controller, and an electrical heating wire generates radiant heat for melting a frost layer. Such a method has the disadvantages: a defrosting system consumes large power; moreover, an electrical heating system has many elements; defrosting is inadequate so that the safety of a product is reduced. In practical situations, large fluctuation of storehouse temperature is often caused, and the storage quality of the food is affected.

SUMMARY OF PRESENT INVENTION

With respect to the shortcoming and deficiency in the prior art, the present invention provides a switchable two-stage and cascade marine energy-saving ultralow-temperature refrigeration system which realizes switching from the two-stage compression refrigeration system having a hot fluorine defrosting loop of an air cooler to the cascade refrigeration system so as to achieve continuous regulation within a section of evaporating temperature of −30° C. to −80° C. and an energy saving effect of hot fluorine defrosting of the air cooler.

The present invention has the technical solution for solving the above technical problem: the switchable two-stage and cascade marine energy-saving ultralow-temperature refrigeration system comprises a high-temperature level refrigeration system, a low-temperature level refrigeration system, a hot fluorine defrosting system of a high-temperature level air cooler and a hot fluorine defrosting system of a low-temperature level air cooler and is characterized in that the high-temperature level refrigeration system is also a stand-alone two-stage refrigeration system; the high-temperature level refrigeration system comprises a high-temperature level compressor, a first oil separator, a second solenoid valve, a water-cooling condenser, a liquid reservoir, a high-temperature level drying filter, a first electronic expansion valve, an intercooler, a first heat regenerator, a fourth solenoid valve, a second electronic expansion valve, a second one-way valve, a high-temperature level air cooler, a tenth solenoid valve, a sixth one-way valve, a fifth solenoid valve, a third electronic expansion valve, a condensation evaporator and a fifth one-way valve which are connected on a pipeline; an outlet of the high-temperature level compressor is connected with an inlet of the first oil separator; the outlet of the first oil separator is divided into two paths; the first path is connected with an inlet of the water-cooling condenser through the second solenoid valve: an outlet of the water-cooling condenser is connected with the liquid reservoir; an outlet of the liquid reservoir is connected with an inlet of the high-temperature level drying filter; an outlet of the high-temperature level drying filter is divided into two paths; the first path is communicated with the high-temperature level compressor through the first electronic expansion valve and the intercooler; the second path is connected with one inlet of the first heat regenerator through the intercooler; one outlet of the first heat regenerator is divided into two paths; the first path is connected with the high-temperature level air cooler through the fourth solenoid valve, the second electronic expansion valve and the second one-way valve; the high-temperature level air cooler is connected with the high-temperature level compressor through the tenth solenoid valve, the sixth one-way valve and the first heat regenerator; the second path is connected with a low-temperature passage of the condensation evaporator through the fifth solenoid valve and the third electronic expansion valve; and an outlet of the low-temperature passage of the condensation evaporator is connected with the high-temperature level compressor through the fifth one-way valve and the first heat regenerator.

The low-temperature level refrigeration system comprises a low-temperature level compressor, a precooler, a second oil separator, a ninth solenoid valve, a condensation evaporator, a low-temperature level drying filter, a second heat regenerator, a liquid lens, a fourth electronic expansion valve, a fourth one-way valve, a low-temperature level air cooler, a seventh solenoid valve and an expansion vessel which are connected on a pipeline; an outlet of the low-temperature level compressor is connected with an inlet of the second oil separator through the precooler; the outlet of the second oil separator is divided into two paths; the first path is connected with a high-temperature passage of the condensation evaporator through the ninth solenoid valve; the high-temperature passage of the condensation evaporator is connected with the low-temperature level drying filter; the outlet of the low-temperature level drying filter is connected with one inlet of the second heat regenerator, and one outlet of the second heat regenerator is connected with the low-temperature level compressor through the liquid lens, the fourth electronic expansion valve, the fourth one-way valve, the low-temperature level air cooler and the seventh solenoid valve.

The hot fluorine defrosting system of the high-temperature level air cooler comprises a high-temperature level compressor, a first oil separator, a first solenoid valve, a high-temperature level air cooler, a third solenoid valve, a first pressure relief valve, a first gas-liquid separator, a first one-way valve and a first heat regenerator which are connected on a pipeline; the outlet of the high-temperature level compressor is connected with the inlet of the first oil separator; the outlet of the first oil separator is divided into two paths; the second path is connected with the first gas-liquid separator through the first solenoid valve, the high-temperature level air cooler, the third solenoid valve and the first pressure relief valve; and the outlet of the first gas-liquid separator is connected with the high-temperature level compressor through the first one-way valve and the first heat regenerator.

The hot fluorine defrosting system of the low-temperature level air cooler comprises a low-temperature level compressor, a precooler, a second oil separator, an eighth solenoid valve, a low-temperature level air cooler, a sixth solenoid valve, a second pressure relief valve, a second gas-liquid separator, a third one-way valve, a second heat regenerator and an expansion vessel which are connected on a pipeline; the outlet of the low-temperature level compressor is connected with the inlet of the second oil separator through the precooler; the outlet of the second oil separator is divided into two paths; the second path is connected with the second gas-liquid separator through the eighth solenoid valve, the low-temperature level air cooler, the sixth solenoid valve and the second pressure relief valve and the outlet of the second gas-liquid separator is connected with the low-temperature level compressor through the third one-way valve and the second heat regenerator.

The high-temperature level compressor and the low-temperature level compressor are variable frequency screw compressors and can realize continuative energy regulation so that the system has high efficiency and energy saving.

The high-temperature level refrigeration system is a stand-alone two-stage refrigeration system and can be used as an independent refrigeration system.

In the high-temperature level refrigeration system, the fifth solenoid valve is started and the fourth solenoid valve is closed for realizing switching from the two-stage compression refrigeration system to the cascade compression refrigeration system.

A switchable two-stage and cascade marine energy-saving ultralow-temperature refrigeration system is characterized in that the condensation evaporator is a plate type heat exchanger.

A switchable two-stage and cascade marine energy-saving ultralow-temperature refrigeration system is characterized in that a refrigerant R404A is applied to the high-temperature level refrigeration system and a refrigerant R23 is applied to the low-temperature level refrigeration system.

In combination with the above features, the switchable two-stage and cascade marine energy-saving ultralow-temperature refrigeration system of the present invention realizes switching from the two-stage compression refrigeration system having a hot fluorine defrosting loop of an air cooler to the cascade refrigeration system by starting/stopping the corresponding solenoid valve so as to effectively expand a section of refrigeration, temperature of the cascade refrigeration system, achieve continuous regulation within a section of evaporating temperature of −30° C. to −80° C. and enhance the performance of the system. The present invention has the advantages of stable operation and obvious energy saving effect. Hot fluorine defrosting of the air cooler has an obvious advantage in application of energy saving and emission reduction.

DESCRIPTION OF THE DRAWINGS

FIG. 1 is a structural diagram of a switchable two-stage and cascade marine energy-saving ultralow-temperature refrigeration system of the present invention as well as a specific embodiment of the present invention.

In the drawings:

1. high-temperature level compressor;
2. first oil separator;
3. first solenoid valve;
4. second solenoid valve;
5. water-cooling condenser;
6. liquid reservoir;
7. high-temperature level drying filter;
8. first electronic expansion valve;
9. intercooler;
10. first heat regenerator;
11. first one-way valve;
12. first gas-liquid separator;
13. first pressure relief valve;
14. third solenoid valve;
15. second one-way valve;
16. second electronic expansion valve;
17. fourth solenoid valve;
18. third electronic expansion valve;
19. fifth solenoid valve;
20. low-temperature level drying filter;
21. second heat regenerator;
22. liquid lens;
23. fourth electronic expansion valve;
24. third one-way valve;
25. second gas-liquid separator;
26. second pressure relief valve;
27. fourth one-way valve;
28. sixth solenoid valve;
29. low-temperature level air cooler;
30. seventh solenoid valve;
31. expansion vessel;
32. low-temperature level compressor;
33. precooler;
34. eighth solenoid valve;
35. second oil separator;
36. ninth solenoid valve;
37. condensation evaporator;
38. fifth one-way valve;
39. sixth one-way valve;
40. tenth solenoid valve; and
41. high-temperature level air cooler.

DETAILED DESCRIPTION OF PREFERRED EMBODIMENTS

To easily understand the operation flow and the creative feature realized by the present invention, the present invention is further elaborated below in combination with specific embodiments.

As shown in FIG. 1, the switchable two-stage and cascade marine energy-saving ultralow-temperature refrigeration system of the present invention comprises a high-temperature level refrigeration system, a low-temperature level refrigeration system, a hot fluorine defrosting system of a high-temperature level air cooler and a hot fluorine defrosting system of a low-temperature level air cooler and is characterized in that the high-temperature level refrigeration system is also a stand-alone two-stage refrigeration system; the high-temperature level refrigeration system comprises a high-temperature level compressor 1, a first oil separator 2, a second solenoid valve 4, a water-cooling condenser 5, a liquid reservoir 6, a high-temperature level drying filter 7, a first electronic expansion valve 8, an intercooler 9, a first heat regenerator 10, a fourth solenoid valve 17, a second electronic expansion valve 16, a second one-way valve 15, a high-temperature level air cooler 41, a tenth solenoid valve 40, a sixth one-way valve 39, a fifth solenoid valve 19, a third electronic expansion valve 18, a condensation evaporator 37 and a fifth one-way valve 38 which are connected on a pipeline; an outlet of the high-temperature level compressor 1 is connected with an inlet of the first oil separator 2; the outlet of the first oil separator 2 is divided into two paths; the first path is connected with an inlet of the water-cooling condenser 5 through the second solenoid valve 4; an outlet of the water-cooling condenser 5 is connected with the liquid reservoir 6; an outlet of the liquid reservoir 6 is connected with an inlet of the high-temperature level drying filter 7; an outlet of the high-temperature level drying filter 7 is divided into two paths; the first path is communicated with the high-temperature level compressor 1 through the first electronic expansion valve 8 and the intercooler 9; the second path is connected with one inlet of the first heat regenerator 10 through the intercooler 9; one outlet of the first heat regenerator 10 is divided into two paths; the first path is connected with the high-temperature level air cooler 41 through the fourth solenoid valve 17, the second electronic expansion valve 16 and the second one-way valve 15; the high-temperature level air cooler 41 is connected with the high-temperature level compressor 1 through the tenth solenoid valve 40, the sixth one-way valve 39 and the first heat regenerator 10; the second path is connected with a low-temperature passage of the condensation evaporator 37 through the fifth solenoid valve 19 and the third electronic expansion valve 18; and an outlet of the low-temperature passage of the condensation evaporator 37 is connected with the high-temperature level compressor 1 through the fifth one-way valve 38 and the first heat regenerator 10.

The low-temperature level refrigeration system comprises a low-temperature level compressor 32, a precooler 33, a second oil separator 35, a ninth solenoid valve 36, a condensation evaporator 37, a low-temperature level drying filter 20, a second heat regenerator 21, liquid lens 22, a fourth electronic expansion valve 23, a fourth one-way valve 27, a low-temperature level air cooler 29, a seventh solenoid valve 30 and an expansion vessel 31 which are connected on a pipeline; an outlet of the low-temperature level compressor 32 is connected with an inlet of the second oil separator 35 through the precooler 33; the outlet of the second oil separator 35 is divided into two paths; the first path is connected with a high-temperature passage of the condensation evaporator 37 through the ninth solenoid valve 36; the high-temperature passage of the condensation evaporator 37 is connected with the low-temperature level drying filter 20; the outlet of the low-temperature level drying filter 20 is connected with one inlet of the second heat regenerator 21; and one outlet of the second heat regenerator 21 is connected with the low-temperature level compressor 32 through the liquid lens 22, the fourth electronic expansion valve 23, the fourth one-way valve 27, the low-temperature level, air cooler 29 and the seventh solenoid valve 30.

The hot fluorine defrosting system of the high-temperature level air cooler comprises a high-temperature level compressor 1, a first oil separator 2, a first solenoid valve 3, a high-temperature level air cooler 41, a third solenoid valve 14, a first pressure relief valve 13, a first gas-liquid separator 12, a first one-way valve 11 and a first heat regenerator 10 which are connected on a pipeline; the outlet of the high-temperature level compressor 1 is connected with the inlet of the first oil separator 2; the outlet of the first oil separator 2 is divided into two paths; the second path is connected with the first gas-liquid separator 12 through the first solenoid valve 3, the high-temperature level air cooler 41, the third solenoid valve 14 and the first pressure relief valve 13; and the outlet of the first gas-liquid separator 12 is connected with the high-temperature level compressor through the first one-way valve 11 and the first heat regenerator 10.

The hot fluorine defrosting system of the low-temperature level air cooler comprises a low-temperature level compressor 32, a precooler 33, a second oil separator 35, an eighth solenoid valve 34, a low-temperature level air cooler 29, a sixth solenoid valve 28, a second pressure relief valve 26, a second gas-liquid separator 25, a third one-way valve 24, a second heat regenerator 21 and an expansion vessel 31 which are connected on a pipeline; the outlet of the low-temperature level compressor 32 is connected with the inlet of the second oil separator 35 through the precooler 33; the outlet of the second oil separator 35 is divided into two paths; the second path is connected with the second gas-liquid separator 25 through the eighth solenoid valve 34, the low-temperature level air cooler 29, the sixth solenoid valve 28 and the second pressure relief valve 26; and the outlet of the second gas-liquid separator 25 is connected with the low-temperature level compressor 32 through the third one-way valve 24 and the second heat regenerator 21.

The working process of the high-temperature level refrigeration system is as follows: closing the first solenoid valve 3; opening the second solenoid valve 4; starting the high-temperature level compressor 1; discharging R404A vapor from the high-temperature level compressor 1 to form high-temperature and high-pressure vapor which enters the first oil separator 2; separating lubricating oil from the refrigerant; entering, by the refrigerant vapor, the water-cooling condenser 5; condensing the refrigerant vapor in the water-cooling condenser 5 into a liquid refrigerant; and then, dividing into two paths through the liquid reservoir 6 and the high-temperature level drying filter 7, wherein one path is communicated with the intercooler 9 through the first electronic expansion valve 8 and the other path is directly communicated with the intercooler 9; the intercooler 9 has a liquid refrigerant outlet and a gaseous refrigerant outlet; the gaseous refrigerant enters a high-pressure cylinder after mixed with the refrigerant discharged from a low-pressure cylinder of the high-temperature level compressor 1; the liquid refrigerant enters the first heat regenerator 10 and is supercooled by the R404A vapor from the high-temperature level air cooler; and the supercooled liquid refrigerant enters the high-temperature level air cooler 41 through the fourth solenoid valve 17, the second electronic expansion valve 16 and the second one-way valve 15 for realizing refrigeration of the high-temperature level air cooler.

According to a difference in setting of refrigeration temperature, switching from the two-stage compression refrigeration system to the cascade refrigeration system can be realized by starting/stopping the corresponding solenoid valve, and the switching process is as follows: on the premise of normal operation of the high-temperature level refrigeration system, opening the fifth solenoid valve 19, closing the fourth solenoid valve 17, starting the low-temperature level refrigeration system, finishing evaporation by the R404A liquid refrigerant in the condensation evaporator 37 and providing cooling amount for R23 condensation.

The working process of the low-temperature level refrigeration system is as follows: closing the eighth solenoid valve 34; opening the ninth solenoid valve 36; starting the high-temperature level compressor 32; discharging R23 vapor from the low-temperature level compressor 32 to form high-temperature and high-pressure vapor which enters the precooler 33 for precooling and releasing heat; then entering the second oil separator 35; separating lubricating oil from the refrigerant, wherein the refrigerant vapor enters the high-temperature passage of the condensation evaporator 37 and is condensed by the R404A liquid refrigerant in the low-temperature passage, and then enters the second heat regenerator 21 through the low-temperature level drying filter 20 and is supercooled and released with heat; and the supercooled R23 liquid refrigerant enters the low-temperature level air cooler 29 for evaporation and heat absorption through the liquid lens 22, the fourth electronic expansion valve 23 and the fourth one-way valve 27 for realizing refrigeration of the low-temperature level air cooler 29, thereby achieving continuous regulation of evaporating temperature of the switchable two-stage and cascade marine energy-saving ultralow-temperature refrigeration system at −30° C. to −80° C.

The hot fluorine defrosting loop of the air cooler enables the high-temperature and high-pressure gas discharged from the compressor to directly pass through a heat exchanger of the air cooler for melting a frost layer coagulated thereon so as to realize the purpose of defrosting. Because the high-temperature and high-pressure gas is heated in the heat exchanger of the air cooler, the defrosting system has short defrosting time, low power consumption, safety and reliability.

The high-temperature level refrigeration system performs defrosting as follows: starting the first solenoid valve 3; closing the second solenoid valve 4; closing the tenth solenoid valve 40; starting the third solenoid valve 14; closing a motor of the high-temperature level air cooler 41; and starting the high-temperature level variable frequency screw compressor 1, wherein R404A vapor enters the high-temperature level variable frequency screw compressor 1 to form high-temperature and high-pressure vapor and enters the oil separator 2; separating lubricating oil from the refrigerant, wherein the refrigerant vapor enters the high-temperature level air cooler 41 through the first solenoid valve 3 for liquidizing, absorbing heat and beginning to defrost, and the R404A liquid refrigerant enters the high-temperature level variable frequency screw compressor 1 in a gaseous form after passing through the third solenoid valve 14, the first pressure relief valve 13, the first gas-liquid separator 12 and the first pressure relief valve 11.

The low-temperature level refrigeration system performs defrosting as follows: starting the eighth solenoid valve 34; closing the ninth solenoid valve 36; closing the seventh solenoid valve 30; starting the sixth solenoid valve 28; starting the low-temperature level variable frequency screw compressor 32; and closing a motor of the low-temperature level air cooler 29, wherein R23 vapor enters the low-temperature level variable frequency screw compressor 32 to form high-temperature and high-pressure vapor, and enters the oil separator 35 through the precooler 33, and separating lubricating oil from the refrigerant, wherein the refrigerant vapor enters the low-temperature level air cooler 29 through the eighth solenoid valve 34 for liquidizing, absorbing heat and beginning to defrost, and the R23 liquid refrigerant enters the low-temperature level variable frequency screw compressor 32 in a gaseous form after passing through the sixth solenoid valve 28, the second pressure relief valve 26, the first gas-liquid separator 25 and the third pressure relief valve 24.

The present invention has the operation features: in a refrigeration process, different refrigeration systems can be switched according to different needs of evaporating temperature; the refrigerating effect is good; temperature control is precise. Meanwhile, the present invention also conforms to the starting feature of a conventional cascade refrigeration system. That is, a high-temperature portion is first started; when the evaporating temperature of the high-temperature portion is decreased enough to ensure that the condensing pressure of a low-temperature portion does not exceed an allowable maximum safely pressure value, the low-temperature portion is started; and in a defrosting process, to ensure safe operation of the system, a loop contrary to the refrigeration loop is adopted for operation. That is, the high-temperature and high-pressure refrigerant vapor enters from the outlet of the refrigerant vapor of the air cooler, and the liquid refrigerant leaves from the liquid refrigerant inlet of the air cooler after absorbing heat and liquidizing and enters the air suction port of the compressor through the pressure relief valve and the gas-liquid separator, thereby avoiding generating an air hammer phenomenon.

Known from the above analysis, a switchable two-stage and cascade marine energy-saving ultralow-temperature refrigeration system of the present invention has the obvious advantages of energy saving and high efficiency in the aspects of improving the problem of narrow section of refrigeration temperature of the cascade refrigeration system and improving the defrosting of the air cooler of the cascade refrigeration system.

What is claimed is:

1. A switchable two-stage and cascade marine energy-saving ultralow-temperature refrigeration system, comprising:

a high-temperature level refrigeration system, a low-temperature level refrigeration system, a hot fluorine defrosting system of a high-temperature level air cooler and a hot fluorine defrosting system of a low-temperature level air cooler;

wherein the high-temperature level refrigeration system is a stand-alone two-stage refrigeration system; the high-temperature level refrigeration system comprises a high-temperature level compressor, an oil separator, a solenoid valve, a water-cooling condenser, a liquid reservoir, a high-temperature level drying filter, an electronic expansion valve, an intercooler, a heat regenerator, a second solenoid valve, a second electronic expansion valve, an one-way valve, the high-temperature level air cooler, a third solenoid valve, a second one-way valve, a fourth solenoid valve, a third electronic expansion valve, a condensation evaporator and a third one-way valve which are connected on a pipeline;

an outlet of the high-temperature level compressor is connected with an inlet of the oil separator, an outlet of the oil separator is divided into two paths; a first path of the outlet of the oil separator is connected with an inlet of the water-cooling condenser through the solenoid valve; an outlet of the water-cooling condenser is connected with the liquid reservoir; an outlet of the liquid reservoir is connected with an inlet of the high-temperature level drying filter; an outlet of the high-temperature level drying filter is divided into two paths; a first path of the outlet of the high-temperature level drying filter is communicated with the high-temperature level compressor through the electronic expansion valve and the intercooler; a second path of the outlet of the high-temperature level drying filter is connected with one inlet of the heat regenerator through the intercooler; one outlet of the heat regenerator is divided into two paths; a first path of the one outlet of the heat regenerator is connected with the high-temperature level air cooler through the second solenoid valve, the second electronic expansion valve and the one-way valve; the high-temperature level air cooler is connected with the high-temperature level compressor through the third solenoid valve, the second one-way valve and the heat regenerator; a second path of the one outlet of the heat regenerator is connected with a low-temperature passage of the condensation evaporator through the fourth solenoid valve and the third electronic expansion valve; and an outlet of the low-temperature passage of the condensation evaporator is connected with the high-temperature level compressor through the third one-way valve and the heat regenerator;

the low-temperature level refrigeration system comprises a low-temperature level compressor, a precooler, a second oil separator, a fifth solenoid valve, the condensation evaporator, a low-temperature level drying filter, a second heat regenerator, a liquid lens, a fourth electronic expansion valve, a fourth one-way valve, the low-temperature level air cooler, a sixth solenoid valve and an expansion vessel which are connected on a pipeline;

an outlet of the low-temperature level compressor is connected with an inlet of the second oil separator through the precooler; an outlet of the second oil separator is divided into two paths; a first path of the outlet of the second oil separator is connected with a high-temperature passage of the condensation evaporator through the fifth solenoid valve; the high-temperature passage of the condensation evaporator is connected with the low-temperature level drying filter; an outlet of the low-temperature level drying filter is connected with one inlet of the second heat regenerator; and one outlet of the second heat regenerator is connected with the low-temperature level compressor through the liquid lens, the fourth electronic expansion valve, the fourth one-way valve, the low-temperature level air cooler and the sixth solenoid valve.

2. The switchable two-stage and cascade marine energy-saving ultralow-temperature refrigeration system according to claim 1, characterized in that the hot fluorine defrosting system of the high-temperature level air cooler comprises the high-temperature level compressor, the oil separator, a seventh solenoid valve, the high-temperature level air cooler, an eighth solenoid valve, a pressure relief valve, a first gas-liquid separator, a fifth one-way valve and the first heat regenerator which are connected on a pipeline; the outlet of the high-temperature level compressor is connected with the inlet of the oil separator; the outlet of the oil separator is divided into two paths the second path is connected with the first gas-liquid separator through the seventh solenoid valve, the high-temperature level air cooler, the eighth solenoid valve and the pressure relief valve; and an outlet of the first gas-liquid separator is connected with the high-temperature level compressor through the fifth one-way valve and the heat regenerator.

3. The switchable two-stage and cascade marine energy-saving ultralow-temperature refrigeration system according to claim 1, characterized in that the hot fluorine defrosting system of the low-temperature level air cooler comprises the low-temperature level compressor, the precooler, the second oil separator, a ninth solenoid valve, the low-temperature level air cooler, a tenth solenoid valve, a pressure relief valve, a second gas-liquid separator, a sixth one-way valve, the second heat regenerator and the expansion vessel which are connected on a pipeline; the outlet of the low-temperature level compressor is connected with the inlet of the second oil separator through the precooler; the outlet of the second oil separator is divided into two paths; the second path is connected with the second gas-liquid separator through the ninth solenoid valve, the low-temperature level air cooler, the tenth solenoid valve and the pressure relief valve; and an outlet of the second gas-liquid separator is connected with the low-temperature level compressor through the sixth one-way valve and the second heat regenerator.

4. The switchable two-stage and cascade marine energy-saving ultralow-temperature refrigeration system according to claim 1, characterized in that the high-temperature level compressor and the low-temperature level compressor are variable frequency screw compressors.

5. The switchable two-stage and cascade marine energy-saving ultralow-temperature refrigeration system according to claim 1, characterized in that the high-temperature level refrigeration system is the stand-alone two-stage refrigeration system and can be used as an independent refrigeration system.

6. The switchable two-stage and cascade marine energy-saving ultralow-temperature refrigeration system according to claim 1, characterized in that in the high-temperature level refrigeration system, the fourth solenoid valve is started and the second solenoid valve is closed for realizing switching from the two-stage compression refrigeration system to the cascade compression refrigeration system.

7. The switchable two-stage and cascade marine energy-saving ultralow-temperature refrigeration system according to claim 1, characterized in that the condensation evaporator is a plate type heat exchanger.

8. The switchable two-stage and cascade marine energy-saving ultralow-temperature refrigeration system according to claim 1, characterized in that a refrigerant R404A is applied to the high-temperature level refrigeration system and a refrigerant R23 is applied to the low-temperature level refrigeration system.

* * * * *